US008070253B2

(12) United States Patent
Kuroda et al.

(10) Patent No.: US 8,070,253 B2
(45) Date of Patent: Dec. 6, 2011

(54) HEAD CLEANING METHOD FOR AN INKJET PRINTER AND AN INKJET PRINTER

(75) Inventors: Kiyomi Kuroda, Nagano-ken (JP); Hiroyuki Motoyama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 415 days.

(21) Appl. No.: 12/397,673

(22) Filed: Mar. 4, 2009

(65) Prior Publication Data

US 2009/0225128 A1 Sep. 10, 2009

(30) Foreign Application Priority Data

Mar. 6, 2008 (JP) ..... 2008-055891

(51) Int. Cl.
*B41J 2/165* (2006.01)

(52) U.S. Cl. ..... 347/23

(58) Field of Classification Search ..... 347/19, 347/20, 22, 23, 29, 33
See application file for complete search history.

(56) References Cited

U.S. PATENT DOCUMENTS 6,695,430 B2 2/2004 Arai et al.
6,719,400 B2 4/2004 Inui et al.
6,739,696 B2 5/2004 Arai et al.
7,380,899 B2 * 6/2008 Arakawa et al. ..... 347/19

FOREIGN PATENT DOCUMENTS

| | | |
|---|---|---|
| JP | 2001-315351 | 11/2001 |
| JP | 2002-264357 | 9/2002 |
| JP | 2003-001835 | 1/2003 |
| JP | 2005-329638 | 12/2005 |
| JP | 2006-168150 | 6/2006 |
| JP | 2006-239999 | 9/2006 |
| JP | 2007-007960 | 1/2007 |

* cited by examiner

*Primary Examiner* — An Do

(57) ABSTRACT

An inkjet printer and a head cleaning method for an inkjet printer reduce the time required for head cleaning while also reducing needless ink consumption. The control unit 30 of the printer 1 confirms if a timer AID flag, impact detection flag, startup process flag, AID hold flag, or cover closed flag is set before executing the cleaning process a first time. If any one of the flags is set, the possibility that there are numerous defective nozzles in the printer 1 is high, and a stronger or more intense cleaning process (CL1 or CL2) is executed. Whether cleaning process CL1 or CL2 executes is determined according to the number of defective nozzles detected in the first nozzle check. If no flag is set, the weakest cleaning process (CL0) is executed.

11 Claims, 4 Drawing Sheets

HEAD CLEANING METHOD FOR AN INKJET PRINTER AND AN INKJET PRINTER

CROSS-REFERENCE TO RELATED APPLICATIONS

Japanese Patent Application No. 2008-055891 is hereby incorporated by reference in its entirety.

BACKGROUND

1. Field of Invention

The present invention relates to a head cleaning method used in an inkjet printer to recover from defective discharge of ink droplets from the nozzles of an inkjet head, and relates to an inkjet printer implementing this head cleaning method.

2. Description of Related Art

Inkjet printers in particular are subject to discharge defects in the ink nozzles of the inkjet head. Such discharge defects include the nozzles becoming clogged by an increase in the viscosity of ink left in the nozzles as well as by air bubbles, dust, or other foreign matter getting into the nozzles, and nozzles that are not completely clogged but become unable to discharge the prescribed amount of ink at the prescribed position on the paper being printed. Nozzles in such a condition are called defective nozzles. Because print quality drops when an inkjet head having defective nozzles is used for printing, the inkjet head is moved regularly or at a predetermined time to a position outside the printing area and a head cleaning process is applied. The inkjet printer taught in Japanese Unexamined Patent Appl. Pub. JP-A-2003-1835, for example, can perform two head cleaning processes, a wiper cleaning process whereby ink on the nozzle surface is removed using a wiper, and a nozzle vacuuming process in which ink is removed from inside the nozzles by suction to prevent or recover from nozzle clogging.

The printer taught in Japanese Unexamined Patent Appl. Pub. JP-A-2007-7960, executes nozzle check and head cleaning processes as part of the startup procedure when the printer power turns on. This printer automatically runs the nozzle check process when the power turns on because the likelihood is high that ink had not been discharged from the nozzles for an extended period of time before the power turned on and the possibility that nozzles are clogged is therefore high. This printer also checks the number of defective nozzles found in the nozzle check, executes a head cleaning process controlled according to the number of defective nozzles if the number of defective nozzles is greater than or equal to a user-defined threshold value, and does not execute the head cleaning process if the number of defective nozzles is less than the set threshold value.

Japanese Unexamined Patent Appl. Pub. JP-A-2003-1835 does not propose checking the nozzles and executing a head cleaning process according to the condition of the nozzles, or executing a head cleaning process controlled according to the condition of the printer while the head is being cleaned.

Japanese Unexamined Patent Appl. Pub. JP-A-2007-7960 teaches cleaning the print head at a time when the possibility is high that there are clogged nozzles, for example, but is silent about changing the content of the cleaning process according to differences in nozzle condition, such as whether or not the likelihood is high that more nozzles than usual are clogged, such as whether or not it is immediately after the power turned on, or whether or not a direct impact was applied to the printer. This means that the cleaning process may be too gentle when the likelihood of there being numerous defective nozzles is high, the cleaning process may take too long to finish, or excessive ink may be consumed.

SUMMARY OF INVENTION

A head cleaning method for an inkjet printer according to the present invention determines the intensity or strength of the cleaning process based on the result of determining if the likelihood of there being numerous defective nozzles is high, and thereby reduces the amount of time required for head cleaning and reduces unnecessary ink consumption.

A first aspect of the invention is a head cleaning method for an inkjet printer, including: a first nozzle check step of detecting if a nozzle of an inkjet head in an inkjet printer is a defective nozzle; a first cleaning process content determination step of determining the content of a first cleaning process for restoring a defective nozzle based on the result of determining if the inkjet printer is in a condition corresponding to a predefined defective nozzle occurrence condition; and a first cleaning step of executing the first cleaning process when a defective nozzle is detected in the first nozzle check step.

The invention thus executes the cleaning process when a defective nozzle is detected by the nozzle check, and thereby reduces wasteful ink consumption by not executing unnecessary cleaning processes. In addition, by deciding if the printer state corresponds to a predefined defective nozzle occurrence condition, whether the possibility that numerous nozzles are clogged is high, for example, can be determined, and a cleaning process configured according to the detected nozzle condition can be executed based on the result of this decision. A faulty discharge condition can therefore be corrected in a short time even if there are numerous nozzles that are not discharging correctly. Ink consumption is also reduced because the strong cleaning process is not executed needlessly.

Preferably, the head cleaning method for an inkjet printer according to another aspect of the invention also has a second nozzle check step of detecting if a nozzle is a defective nozzle after the first cleaning step; a second cleaning process content determination step of determining the content of a second cleaning process for recovering the defective nozzle independently of the defective nozzle occurrence condition; and a repeating step of executing the following two steps once or a plurality of times, that is, a second cleaning step of executing the second cleaning process when a defective nozzle is detected in the second nozzle check step, and a third nozzle check step of detecting if a nozzle is a defective nozzle after the second cleaning step.

By thus determining the content of only the first cleaning process based on determining whether or not a predetermined defective nozzle occurrence condition is satisfied, and executing the second and subsequent cleaning processes irrespective of the initial determination, needlessly repeating the strong cleaning process can be prevented. Ink consumption can also be reduced.

In a head cleaning method for an inkjet printer according to another aspect of the invention, the first cleaning process content determination step determines the content of the first cleaning process based on the result of determining if the inkjet printer satisfies any of defective nozzle occurrence conditions including that shock was applied to the inkjet printer, an opening/closing member of the inkjet printer closed, the inkjet printer turned on, a predetermined time passed since the last preceding cleaning process or printing process, and execution of the cleaning process was suspended.

More specifically, the first cleaning process discharges more ink or vacuums more ink from the nozzles when the inkjet printer is determined to satisfy at least one defective nozzle occurrence condition than when none of the defective nozzle occurrence conditions are satisfied.

Because this aspect of the invention determines, for example, if the possibility of there being numerous clogged nozzles is high based on predetermined defective nozzle occurrence conditions, head cleaning can be completed with fewer operations and less ink consumption by applying a cleaning process having a large ink discharge or vacuum volume only when the defective nozzle occurrence condition is satisfied.

In another aspect of the invention, the second cleaning process content determination step determines the content of the second cleaning process according to how many times the second cleaning step executed.

This aspect of the invention enables changing the content of each subsequent cleaning process when the cleaning process is repeated because unrecovered defective nozzles remain, and thus avoids repeating a weak cleaning process when nozzle clogging, for example, is severe.

In another aspect of the invention the first cleaning process content determination step determines the content of the first cleaning process based on the result of said determination and the result of defective nozzle detection in the first nozzle check step.

This aspect of the invention can determine the content of the cleaning process based on the result of the nozzle check performed before the first cleaning process is applied, and can therefore implement a cleaning process that is better adjusted to the actual condition of the nozzles. The time required to recover from a defective discharge condition can therefore be shortened.

Another aspect of the invention is an inkjet printer having a nozzle check unit that executes a first nozzle check process of detecting if a nozzle of a head is a defective nozzle; a cleaning unit that cleans the head; a cleaning process content determination unit that determines the content of a first cleaning process for restoring a defective nozzle based on the result of the determining if a predefined defective nozzle occurrence condition is satisfied; and a control unit that controls the cleaning unit, and executes the first cleaning process when a defective nozzle is detected.

Preferably, the nozzle check unit executes a second nozzle check process of detecting if a nozzle is a defective nozzle after the first cleaning process, the cleaning process content determination unit determines the content of a second cleaning process for recovering the defective nozzle independently of the defective nozzle occurrence condition, and the control unit executes the following two processes once or a plurality of times when a defective nozzle is detected in the second nozzle check process, that is, the second cleaning process, and a third nozzle check process of detecting if a nozzle is a defective nozzle after the second cleaning process.

Further preferably, the cleaning process content determination unit determines the content of the first cleaning process based on the result of determining if in the first cleaning process the inkjet printer satisfies any of defective nozzle occurrence conditions including that shock was applied to the inkjet printer, an opening/closing member of the inkjet printer closed, the inkjet printer turned on, a predetermined time passed since the last preceding cleaning process or printing process, and execution of the cleaning process was suspended. Yet more specifically, the first cleaning process discharges more ink or vacuums more ink from the nozzles when at least one defective nozzle occurrence condition is satisfied than when none of the defective nozzle occurrence conditions are satisfied.

In an inkjet printer according to another aspect of the invention the cleaning process content determination unit determines the content of the second cleaning process according to how many times the second cleaning step executed.

Further preferably, the cleaning process content determination unit determines the content of the first cleaning process based on the result of said determination and the result of defective nozzle detection in the first nozzle check process

Effect of the Invention

By determining if the condition of the printer satisfies a predetermined defective nozzle occurrence condition, the invention can determine if the possibility of the printer having numerous clogged nozzles, for example, is high, and based on the result of this decision can execute a cleaning process determined according to the condition of the nozzles. The printer can therefore be restored to a normal condition even if there are numerous malfunctioning nozzles. Ink consumption can also be reduced because a strong cleaning process is not executed needlessly.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A preferred embodiment of the present invention is described below with reference to the accompanying figures.

General Configuration

Figure 1:
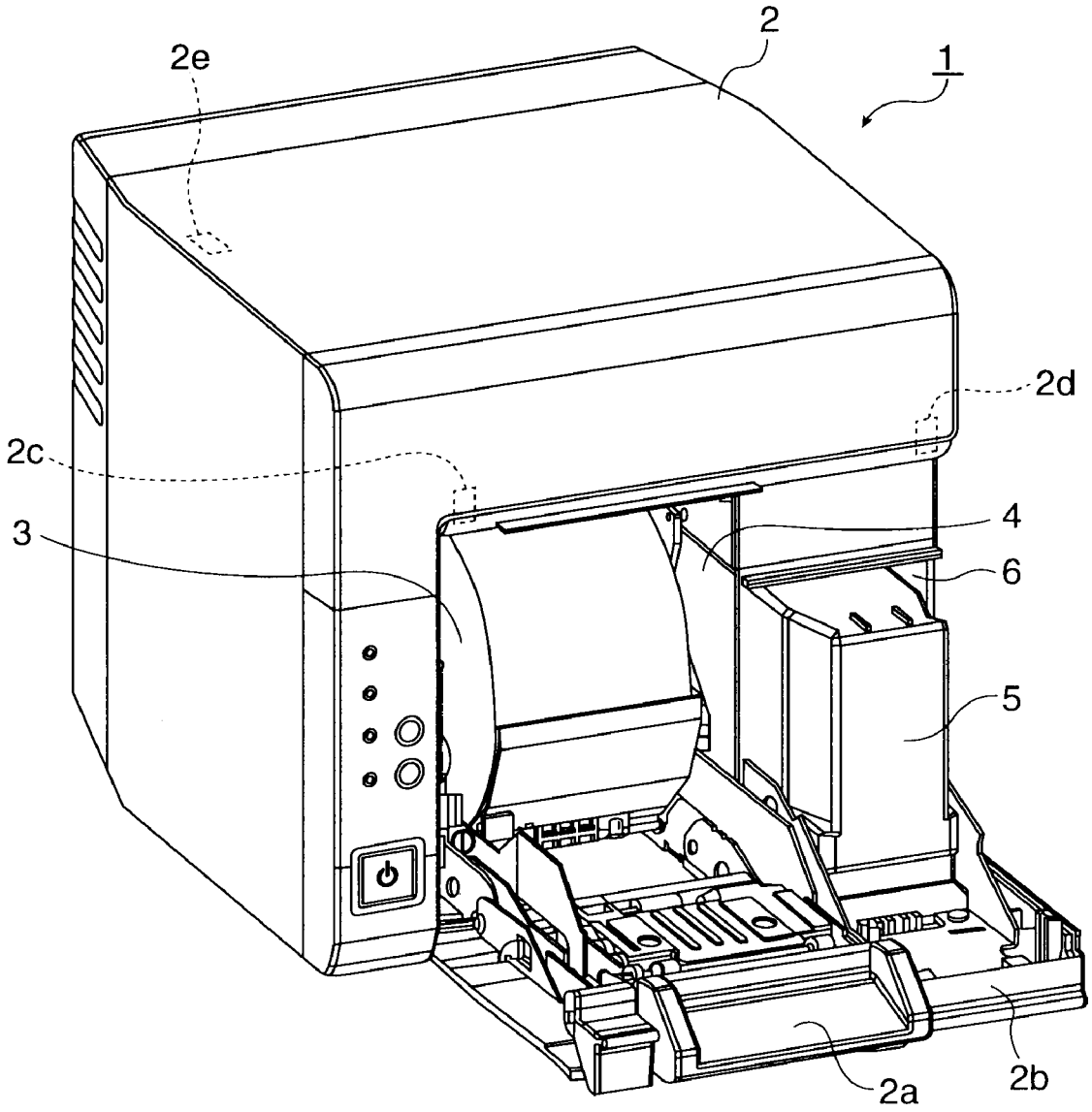
FIG. 1 is an oblique view of an inkjet printer according to the present invention.
Figure 2:
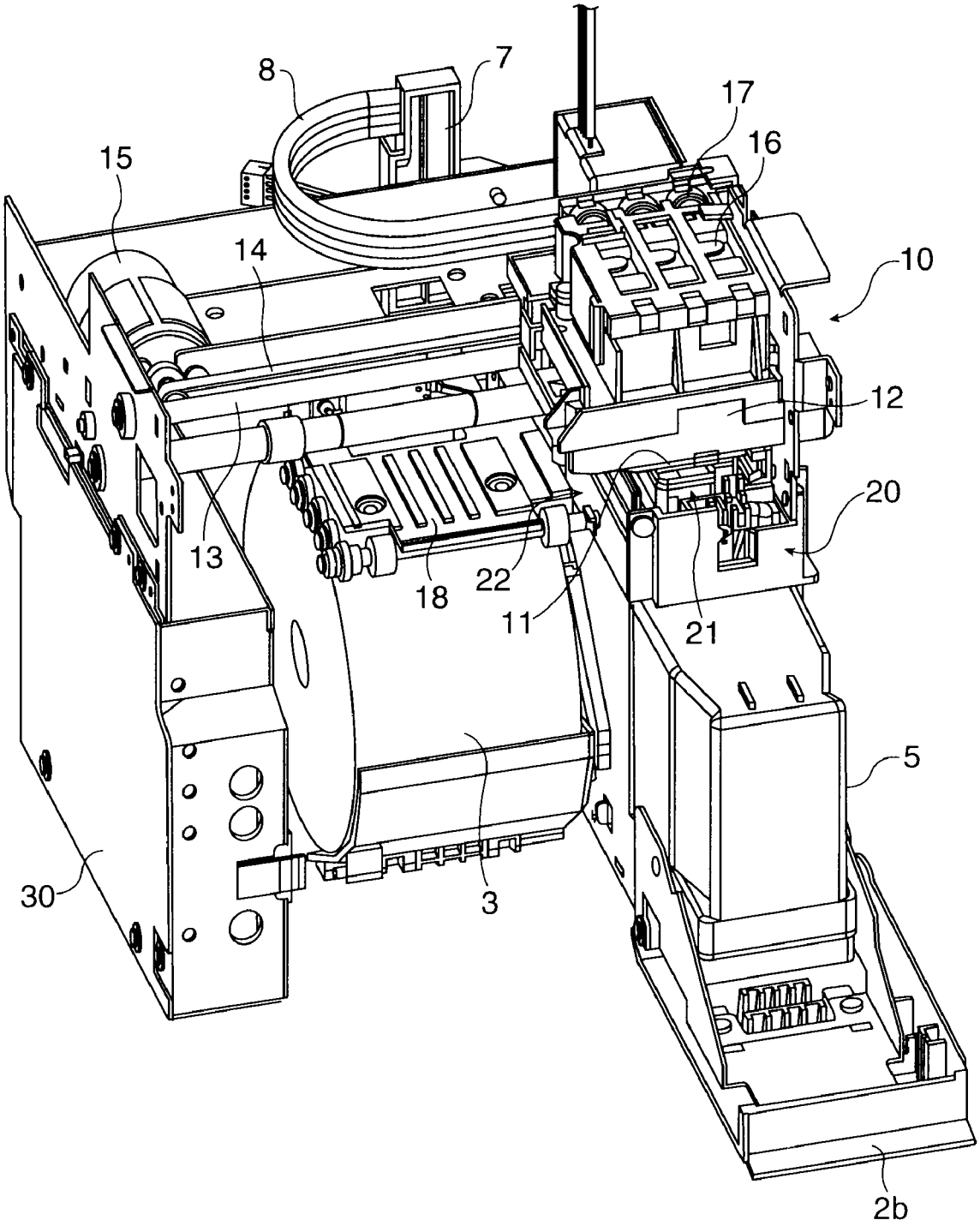
FIG. 2 is an oblique view showing the internal construction of the inkjet printer.

FIG. 1 is an oblique view of an inkjet printer, and FIG. 2 is an oblique view showing the internal construction of the same inkjet printer with the outside case removed.

This inkjet printer 1 (referred to as simply "printer 1" below) holds roll paper 3 as the printing paper inside the box-like case 2 so that the roll paper 3 can roll freely. The printer 1 includes a printing mechanism 10, a head cleaning mechanism 20 (a cleaning unit), and a control unit 30.

The printing mechanism 10 discharges ink droplets and prints on the continuous paper pulled from the roll paper 3.

The head cleaning mechanism 20 is for recovering from ink droplet discharge problems and restoring the printing mechanism 10 to the normal printing condition. Ink droplet discharge problems include both poor discharge of ink and the inability to discharge ink droplets.

The control unit 30 receives print data and commands from a host device, and controls operation of the printing mechanism 10 and head cleaning mechanism 20.

The printer 1 also has a paper transportation mechanism for pulling and conveying continuous paper from the roll paper 3, and a paper cutter mechanism for cutting the continuous paper at the paper exit inside the case 2.

A roll paper cover 2*a* and an ink cartridge cover 2*b* (open/close member) are disposed side by side at the front of the case 2. Both covers are disposed so that they can open forward. When the roll paper cover 2*a* opens, the roll paper compartment 4 inside the case 2 opens so that the roll paper 3 can be loaded or replaced. When the ink cartridge cover 2*b* opens, an ink cartridge compartment 6 for loading an ink cartridge 5 containing ink opens and the ink cartridge 5 can be installed or removed.

An open/close sensor 2*c* for detecting if the roll paper cover 2*a* closed, and an open/close sensor 2*d* for detecting if the ink cartridge cover 2*b* closed, are disposed to a front part of the case 2 near the edge of the opening communicating with the roll paper compartment 4 or ink cartridge compartment 6, respectively. A Hall effect sensor or reed switch may be used for the open/close sensors 2*c* and 2*d*. The open/close sensors may be disposed to a hinge part disposed to the bottom end of the roll paper cover 2*a* and ink cartridge cover 2*b*.

An impact sensor 2*e* for detecting external shock applied to the printer 1 is also disposed at a predetermined position inside the case 2. This impact sensor 2*e* may operate using a piezoelectric material or position sensor to detect movement of a pendulum caused by acceleration at the time of impact.

Detection signals from the open/close sensors 2*c* and 2*d* and impact sensor 2*e* are input to the control unit 30. The control unit 30 also includes an internal cumulative counter ACL and timer.

The ink cartridge 5 contains a predetermined number of ink packs inside the cartridge case. In a printer capable of color printing, a plurality of ink packs containing different colors of ink are stored in the ink cartridge 5. When the ink cartridge cover 2*b* opens, the ink cartridge 5 is pulled forward together with the ink cartridge cover 2*b*. When the ink cartridge 5 is loaded in the ink cartridge compartment 6, ink supply needles disposed to the ink cartridge compartment 6 side are inserted and connected to the ink supply openings in the ink packs inside the ink cartridge 5. These ink supply needles are connected to an ink path 7 that passes through the inside of the ink cartridge compartment 6 and then rises. A flexible ink supply tube 8 is connected to the top end of the ink path 7.

The roll paper compartment 4 and ink cartridge compartment 6 are disposed side by side left and right inside the printer 1, and the printing mechanism 10 is disposed above the roll paper 3 and ink cartridge 5 installed in the roll paper compartment 4 and ink cartridge compartment 6.

The printing mechanism 10 has a carriage 12 on which the inkjet head 11 (also referred to as simply "head 11" below) is mounted disposed slidably on a carriage shaft 13 that extends horizontally across the width of the roll paper 3. The carriage 12 is connected to the output shaft of a carriage motor 15 by an endless belt 14, and the inkjet head 11 moves bidirectionally widthwise to the printer, that is, across the width of the roll paper, as the carriage motor 15 turns.

The inkjet head 11 has a nozzle surface 11*a* in which a plurality of nozzles for discharging ink are formed, and the nozzle surface 11*a* is exposed facing down on the bottom of the carriage 12. A back pressure adjustment unit 16 connected to the inkjet head 11 is disposed on top of the carriage 12, and the back pressure adjustment unit 16 is connected through a damper unit 17 connected to its back to the distal end of the ink supply tube 8. When the inkjet head 11 moves bidirectionally through the printing position on the platen 18 disposed above the roll paper 3, ink droplets are discharged from the nozzles of the nozzle surface 11*a* to print on the printing paper conveyed to the platen 18. When not printing, the inkjet head 11 moves to the right end of the carriage shaft 13 and stops at a standby position above the ink cartridge 5.

Head Cleaning Mechanism

Figure 3:
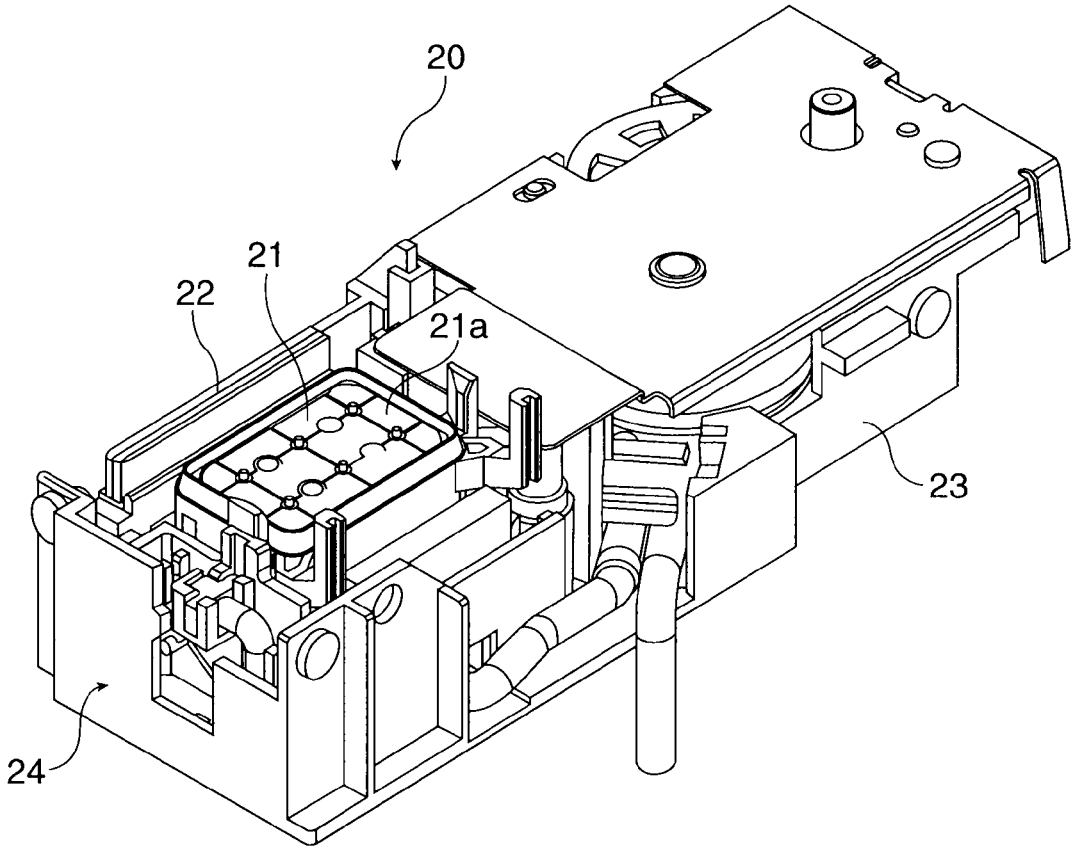
FIG. 3 is an oblique view of the head cleaning mechanism.

FIG. 3 is an oblique view of the head cleaning mechanism. The head cleaning mechanism 20 is located directly above the ink cartridge 5 installed in the ink cartridge compartment 6, and the inkjet head 11 is below the head cleaning mechanism 20 when the inkjet head 11 is in the standby position.

The head cleaning mechanism 20 includes a head cap 21, a wiper 22, and an ink suction unit 23. The head cap 21 caps the nozzle surface 11*a* of the inkjet head 11. The wiper 22 wipes ink and foreign matter from the nozzle surface 11*a*. The ink suction unit 23 vacuums ink that is left in or is clogging the ink nozzles of the inkjet head 11. The head cap 21, wiper 22, and ink suction unit 23 are disposed to the frame 24 of the head cleaning mechanism 20. The frame 24 is fastened to the main frame of the printer 1 that supports the carriage shaft 13 and platen 18, for example.

The head cap 21 is located directly below the nozzle surface 11*a* in the standby position, and has a capping surface 21*a* facing up directly opposite the nozzle surface 11*a*. The head cap 21 can be slid perpendicularly to the nozzle surface 11*a*, that is, vertically perpendicularly to the carriage shaft 13, by operating a drive mechanism not shown. The head cap 21 can thus be moved in the direction causing the capping surface 21*a* to move to or away from the nozzle surface 11*a*. The drive mechanism used as the drive power source of the head cap 21 operates according to control signals from the control unit 30, and causes the head cap 21 to move up or down.

Figure 4:
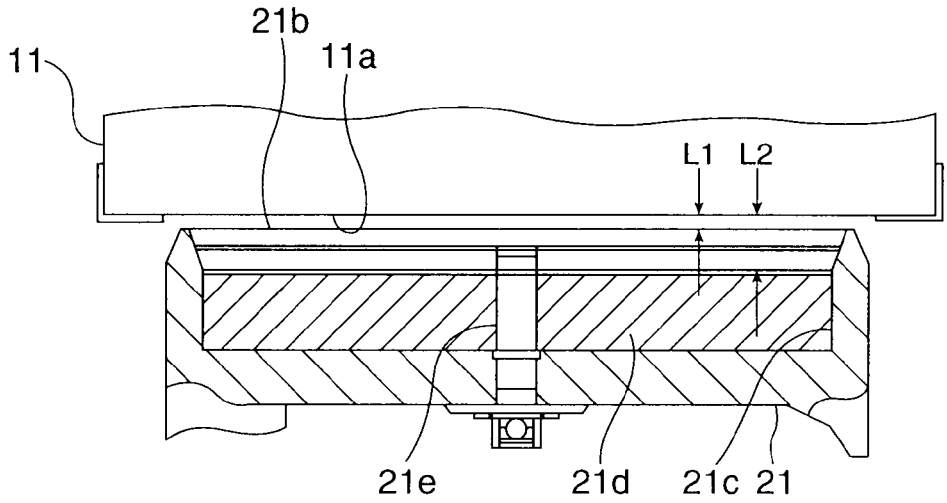
FIG. 4 is a partial section view showing the print head directly opposite the head cap.

FIG. 4 is a partial section view showing the inkjet head 11 opposite the head cap 21. As shown in this figure, the head cap 21 is made of rubber or other elastic material, and has a box-like shape with the edge portion 21*b* of the capping surface 21*a* rising vertically. The head cap 21 is of a size and shape enabling it to cover the part of the nozzle surface 11*a* where the nozzles are formed with the edge portion 21*b* pressed to the nozzle surface 11*a*. A vacuum tube extending from the pump motor (not shown in the figure) of the ink suction unit 23 is connected to the inside of a well 21*c* surrounded by the capping surface 21*a* and edge portion 21*b*. When the pump motor is operated with the edge portion 21*b* against the nozzle surface 11*a*, suction from the pump motor creates a vacuum in the sealed space surrounded by the well 21*c* and nozzle surface 11*a*, causing ink left in the nozzles of the inkjet head 11 to be vacuumed and discharged into the well 21*c*.

An absorbent material 21*d* for absorbing the vacuumed waste ink is held inside the well 21*c*, and a conductor 21*e* is provided for electrical conductivity with the absorbent material 21*d*. Electrical signals passing through the conductor 21*e* are extracted by a wire, for example, and input to the control unit 30. In this embodiment of the invention charged ink is discharged from the nozzles of the inkjet head 11, and signals denoting the change in current produced when the charged ink lands on the absorbent material 21*d* can be extracted. If this signal is less than or equal to a predetermined threshold value even though ink was discharged, it can be determined that a nozzle discharge defect has occurred.

Note that other methods of detecting defective nozzles may be used, including, for example, using a laser or other optical component to detect discharged ink droplets.

The wiper 22 is a flat member made of rubber or other elastic material, and is supported so that it can slide vertically on a guide member not shown fastened to the frame 24 of the head cleaning mechanism 20. Similarly to the head cap 21, the wiper 22 is rendered so that it can move perpendicularly to the nozzle surface 11*a* by operating a drive mechanism not shown. When the wiper 22 wipes the nozzle surface 11*a*, the wiper 22 is first raised with the nozzle surface 11*a* removed from directly above the wiper 22, the distal end of the wiper 22 is positioned slightly higher than the elevation of the nozzle surface 11*a*, and the inkjet head 11 is then moved along the carriage shaft 13 with the nozzle surface 11*a* rubbing against the distal end of the wiper 22. This enables the distal end of the wiper 22 to wipe foreign matter and ink from the nozzle surface 11*a*.

Controlling the Head Cleaning Mechanism

When a print job ends and the inkjet head 11 is waiting at the standby position, the control unit 30 moves the head cap 21 to the position where the edge portion 21*b* seals around the nozzle surface 11*a* in order to cap the nozzles. This inhibits an increase in the viscosity of the ink left in the nozzles during the standby state, and thus helps prevent nozzle clogging. The control unit 30 can also execute the wiping process of wiping the nozzle surface 11*a* with the wiper 22 by causing the wiper 22 to rise synchronized to the timing of the inkjet head 11 moving to the standby position side or printing position side.

If head cleaning becomes necessary due, for example, to nozzle clogging, the head cleaning mechanism 20 executes an ink suction process of operating the pump motor with the head cap 21 moved to the position capping the nozzles, thereby creating a vacuum in the sealed space enclosed by the well 21*c* and nozzle surface 11*a*, and causing ink to be discharged from the nozzles.

The control unit 30 also regularly executes a flushing process in order to keep the ink in the nozzles in a condition suitable for printing. This flushing process positions the inkjet head 11 opposite the head cap 21, and then discharges a predetermined amount of ink from all nozzles of the inkjet head 11 irrespective of the printing operation into the well 21*c* of the head cap 21. A flushing process that discharges a larger volume of ink droplets at one time than the volume of ink droplets discharged in the regular flushing process may also be executed at a desired time to clean the print head and restore clogged nozzles.

The control unit 30 can execute the wiping process, ink suction process, or flushing process individually or in combination as the cleaning process, but before actually executing these processes executes a nozzle check process to inspect the ink discharge condition from each nozzle.

If the nozzle check process is executed after the cleaning process, whether the ink discharge problem was corrected by the cleaning process can be determined, and whether the cleaning process needs to be repeated can be determined.

More specifically, the nozzle check process discharges charged ink from the nozzles of the inkjet head 11, and inspects the ink discharge state of each nozzle based on the current change signal detected when the discharged ink lands on the absorbent material 21*d* in the well 21*c*. When this nozzle check process is executed, the head cap 21 is positioned so that the gap L1 between the nozzle surface 11*a* and the top edge of the edge portion 21*b* of the head cap 21, and the gap L2 between the nozzle surface 11*a* and the surface of the absorbent material 21*d*, are predetermined sizes, and voltage is then applied so that the potential difference between the inkjet head 11 and head cap 21 is greater than or equal to a predetermined threshold value. This enables inspecting the ink droplet discharge state with good precision.

Control During the Head Cleaning Process

When the printer 1 described above executes the head cleaning process under a predetermined condition (a state corresponding to the defective nozzle occurrence condition) in which there is the possibility of numerous defective nozzles, the first cleaning process that is executed by the printer 1 first is more intense than the usual cleaning process, thereby enabling completing the head cleaning process with the least possible number of cleaning operations and the least ink consumption.

As an example of the numerous cleaning processes that can be executed using the ink suction process, flushing process, and wiping process individually or in combination, the cleaning process described below selects and executes one of four ink suction processes that differ in the amount of ink that is vacuumed from the nozzles according to the defective nozzle occurrence condition and other implementation conditions.

Figure 5:
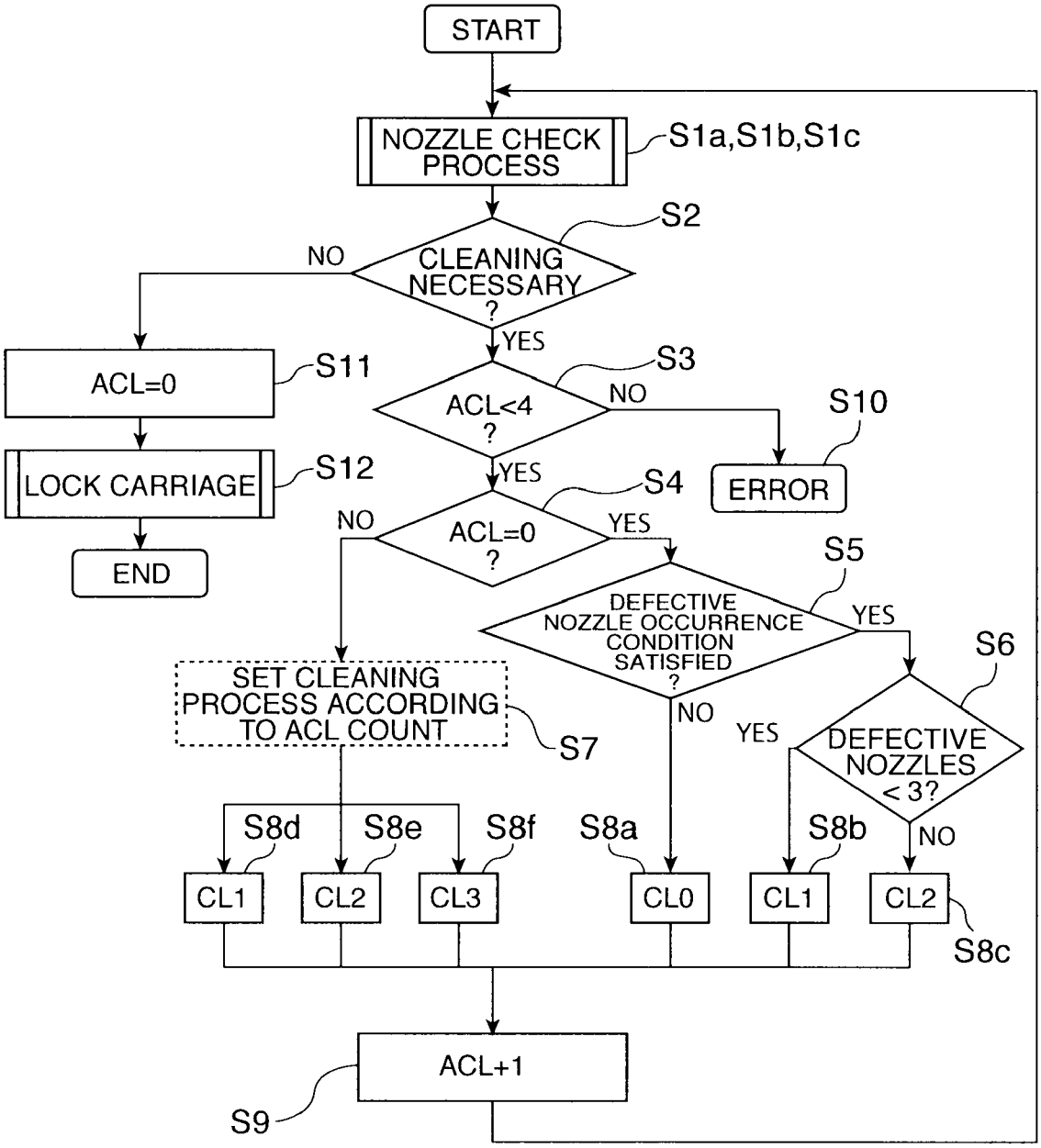
FIG. 5 is a flow chart of the head cleaning process.

FIG. 5 is a flow chart of the head cleaning process according to this embodiment of the invention. Before starting the head cleaning process, the control unit 30 detects if the printer 1 is in a defective nozzle occurrence condition as described in (1) to (5) below, and sets the corresponding flag accordingly.

(1) Timer AID Flag

The printer 1 executes the head cleaning process regularly or at a specified time. Therefore, if the control unit 30 detects from an internal timer that a predetermined time has passed since the most recent printing process or head cleaning process, it sets a timer AID flag. The timer AID flag may also be set when a predetermined time has passed since a specified process other than a printing process or head cleaning process.

(2) Impact Detection Flag

The sets the impact detection flag if it detects from the impact sensor 2*e* that a predetermined shock was applied to the printer 1. If the printer 1 detects a shock when the impact detection flag has already been set, the impact detection flag remains set.

(3) Startup Process Flag

When the power switch of the 1 turns on, when a startup signal or reset signal is input from the host device, or a reset signal is detected internally in the printer 1, the control unit 30 executes the startup process or restart process and sets the startup process flag.

(4) Suspend Head Cleaning Flag (AID Hold Flag)

If the head cleaning process that executes regularly or at a specified time cannot be run because, for example, the printer 1 is in the middle of a printing process when the time to start the head cleaning process arrives, the control unit 30 suspends the head cleaning process and sets the suspend head cleaning flag (referred to below as the AID hold flag).

(5) Cover Closed Flag

The control unit 30 sets the cover closed flag in two situations, when the open/close sensor 2*c* detects that the roll paper cover 2*a* (opening/closing member) of the printer 1 closed, and when the open/close sensor 2*d* detects that the ink cartridge cover 2*b* (opening/closing member) of the printer 1 closed. If the cover closed flag is already set and opening and closing of the roll paper cover 2*a* or ink cartridge cover 2*b* is detected again, the cover closed flag remains set.

The control unit 30 regularly checks if the timer AID flag is set and starts the head cleaning process if it detects that the timer AID flag is set. If a specific operation for starting the head cleaning process is performed at the operating unit of the printer 1, or an execute head cleaning process command is input from the host device, the control unit 30 starts the head cleaning process irrespective of the timer AID flag setting based on the user operation or the execute head cleaning process command.

When the head cleaning process starts, the control unit 30 (a nozzle check unit) first executes the first nozzle check process (S1*a*: first nozzle check step). Whether cleaning is needed or not is then determined based on the result of defective nozzle detection in this nozzle check process (S2). This cleaning requirement test (S2) determines that cleaning is needed if even one defective nozzle is found, and determines that cleaning is not needed if no defective nozzles are found. If the inkjet head 11 is not at the standby position when the head cleaning process starts, the inkjet head 11 is returned to the standby position before the first nozzle check process (S1*a*) executes. The threshold value used in the cleaning requirement test (S2) may be set as desired. For example, the cleaning process may be determined necessary if the number of defective nozzles is greater than or equal to n (where n is an integer of 2 or more).

If the control unit 30 determines in the cleaning requirement test (S2) that cleaning is needed (S2 returns Yes), the control unit 30 determines if the count of the cumulative counter ACL is or is not less than 4 (S3).

The cumulative counter ACL is a counter rendered in the control unit 30, and each time the cleaning process (a cleaning step) executes the control unit 30 (a counting unit) increments the cumulative counter ACL by one. The count kept by the cumulative counter ACL denotes how many times the head cleaning process was executed before the current head cleaning process. As described below, the cumulative counter ACL is reset at the completion of each head cleaning process. At the beginning of each head cleaning process, therefore, ACL=0.

If the count kept by the cumulative counter ACL is less than 4 in step S3, the control unit 30 determines if the count of the cumulative counter ACL is 0 (S4). If the count of the cumulative counter ACL is 0 (S4 returns Yes), indicating the cleaning process has not executed even once yet, the control unit 30 (a cleaning process content determination unit) sets the content of the first cleaning process through steps S5 and S6 (first cleaning process content determination step).

The control unit 30 therefore determines if the timer AID flag, impact detection flag, startup process flag, AID hold flag, or cover closed flag described in (1) to (5) above is set (S5). If no flag is set (S5 returns No), the ink suction process CL0 that removes the least amount of ink is selected as the cleaning process and run (S8*a*). More specifically, because none of the flags (1) to (5) are set, the control unit 30 determines that the printer 1 is not in a defective nozzle occurrence condition. Based on this decision, therefore, the weakest (least intense) cleaning process, CL0, is executed.

If one or more of the flags, that is, the timer AID flag, impact detection flag, startup process flag, AID hold flag, or cover closed flag, is set (S5 returns Yes), the control unit 30 determines that the printer 1 is in a condition corresponding to at least one defective nozzle occurrence condition. As a result, the control unit 30 determines if the number of defective nozzles detected in the first nozzle check process (S1) is less than 3 (S6). Step S6 thus determines the degree of nozzle clogging based on the detected number of defective nozzles. If the number of defective nozzles is less than 3 (S6 returns Yes), nozzle clogging is not that severe, and the ink suction process CL1 (second weakest cleaning process) that removes the second least amount of ink is selected as the cleaning process and run (S8*b*).

If the number of defective nozzles is 3 or more (S6 returns No), there are defective nozzles and the ink suction process CL2 (third weakest cleaning process) that removes the third least amount of ink is selected as the cleaning process and run (S8*c*).

By thus executing steps S5 and S6 before running the first cleaning process, the control unit 30 determines the content of the first cleaning process based on the result of determining if the printer 1 is in a defective nozzle occurrence condition and based on the determining if the detected number of defective nozzles is less than a predetermined threshold value. Note that the threshold value used for defective nozzle detection in step S6 may be a number other than 3.

After executing the cleaning process selected as the first cleaning process in step S8*a* to S8*c*, the control unit 30 increments the cumulative counter ACL by 1 (S9). The control unit 30 (the nozzle check unit) then repeats the nozzle check process (S1*b*: second nozzle check process). If a defective nozzle is found, processing continues to steps S3 and S4. After the cleaning process is executed once, the value of the cumulative counter ACL in step S4 is not 0 (S4 returns No), and control therefore goes to S7.

In step S7 the control unit 30 (the cleaning process content determination unit) determines the content of the cleaning process based on the value of the cumulative counter ACL and ignores the defective nozzle occurrence condition and number of defective nozzles detected in the nozzle check process (S7: second cleaning process content determination step).

If ACL=1 in step S7, that is, this is the second time the head will be cleaned, the control unit 30 selects and executes the cleaning process (CL1) that removes the second least amount of ink (S8*d*).

If ACL=2, that is, this is the third time the head will be cleaned, the control unit 30 selects and executes the cleaning process (CL2) that removes the third least amount of ink (S8*e*).

If ACL=3, that is, this is the fourth time the head will be cleaned, the control unit 30 selects and executes the cleaning process (CL3, the strongest cleaning process) that removes the most amount of ink (S8*f*).

After executing the cleaning process selected as the second cleaning process in step S8*d* to S8*f*, the control unit 30 increments the cumulative counter ACL by 1 (S9). The control unit 30 then repeats the nozzle check process (S1*c*: third nozzle check process). If a defective nozzle is found, processing continues. The step of selecting and executing the ink suction process corresponding to the value stored by the cumulative counter ACL (S8*d* to S8*f*), and the nozzle check process (S1*c*), then repeat in order until control goes to the error handling step (S10) or the head cleaning termination steps (S11 and S12).

If the control unit 30 determines that the value of the cumulative counter ACL is not less than 4 in step S3 (S3 returns No), an error is returned (S10) because defective nozzles are still being found even though the cleaning process has been executed at least a predetermined number of times. This error handling step (S10) may send an error signal denoting a cleaning error to the host device to display an error message on the display of the host device, or cause an error indicator on the printer 1 to light or an error message to be displayed on the liquid crystal display device of the printer 1, or cause an audible alarm to sound, for example.

If not even one defective nozzle is found by the nozzle check process (S1*a* to S1*c*), the control unit 30 determines in the cleaning requirement test that cleaning is not needed (S2 returns No), and resets the cumulative counter ACL to 0 (S11). The inkjet head 11 is then returned to the standby position and the carriage 12 is locked (S12). This completes the head cleaning process. When head cleaning is completed normally, the control unit 30 clears the timer AID flag, impact detection flag, startup process flag, AID hold flag, and cover closed flag.

Effect of the Invention

As described above, by checking (S5) if any one of a group of flags including an timer AID flag, impact detection flag, startup process flag, AID hold flag, and cover closed flag is set before the first cleaning process (S8*a* to S8*c*) is executed, this embodiment of the invention determines if the condition of the printer 1 corresponds to a defective nozzle occurrence condition. If any one of these flags is set and the likelihood that there is a defective nozzle is therefore determined to be high, a cleaning process (CL1 or CL2) that is stronger (more intense) than the cleaning process (CL0) used when there is no possibility of defective nozzles is executed.

Whether cleaning process CL1 or CL2 executes is determined based on the number of defective nozzles detected in the first nozzle check process (S1*a*).

Because the content of the first cleaning process can therefore be adjusted to an intensity (strength) appropriate to the condition of the nozzles, clogging and other problems can be corrected with fewer cleaning operations than when the weakest cleaning process is always executed first as in the related art.

In addition, because the strength of the cleaning process is gradually increased in the second and subsequent cleaning processes by increasing the amount of ink that is vacuumed from the print head as the number of times the cleaning process executes (is repeated) increases, repeating a weak cleaning process when the nozzle clogging or other problem is severe is avoided. As a result, defective nozzles can be restored to normal in a short time. Unnecessary ink consumption can also be reduced because unnecessarily strong cleaning processes are avoided.

Furthermore, because this embodiment of the invention always confirms if there are defective nozzles by running the nozzle check process (S1*a* to S1*c*) before the ink suction process, whether there are actually any clogged nozzles can be checked and the ink suction process can be determined based on the result of this check. Therefore, because head cleaning can be ended quickly as soon as the nozzle clogging or other problem is corrected, the time used for head cleaning can be shortened and consumption of ink and other consumables can be reduced. In addition, once head cleaning starts, the cleaning process can automatically repeat until a preset maximum number of times is reached.

Other Embodiments of the Invention (1) The embodiment described above determines if at least one flag is set in a group of flags including the timer AID flag, impact detection flag, startup process flag, AID hold flag, and cover closed flag, but the strength of the cleaning process executed as the first cleaning process may be changed according to what flag is set or the combination of set flags, for example. For example, the strength of the cleaning process may be increased as the number of set flags increases. Flags other than the timer AID flag, impact detection flag, startup process flag, AID hold flag, and cover closed flag, such as a flag that is set when the printer 1 is detected to be tilted, or a flag that is set when the inkjet head 11 or other part is replaced, may also be added to the defective nozzle occurrence conditions.

(2) The embodiment of the invention executes four ink suction processes that differ in the amount of ink vacuumed from the head as the cleaning process, but a flushing process or wiping process may be executed, or an appropriate combination of these processes may be executed. The ink suction volume of the ink suction process, and the ink discharge volume of the flushing process, may also be changed appropriately. The amount of ink that is vacuumed or discharged may also be changed according to the number of defective nozzles detected in the nozzle check process immediately preceding the cleaning process.

(3) Whether particular defective nozzle occurrence conditions are met is determined in the foregoing embodiment by setting and checking the status of flags such as the cover closed flag, but other methods may be used instead. For example, when the nozzles are checked, the cause of the nozzle check, that is, why the nozzles are being checked, may be stored, and the content of the first cleaning process may be determined according to this stored cause. Because possible causes for a nozzle check include the end of printing, manual cleaning commands asserted by the user, and factory or service commands, in addition to a cover closing, impact detection, timer AID, and a startup process when the power turns on, the source of the nozzle check request is stored so that the cause can be identified. Note that nozzle check requests cannot be received when a nozzle check is in progress, and other causes cannot be set. The AID hold flag can be set as described in the foregoing embodiment.

In this aspect of the invention the state of the AID hold flag and the content of the stored cause are checked in step S5 described above, and the printer 1 is determined to meet a defective nozzle occurrence condition if the cause matches a predefined cause or the AID hold flag is set. If the source of the nozzle check request does not match a preset cause, and the AID hold flag is not set, the printer 1 is determined to not meet the defective nozzle occurrence condition. If head cleaning ends normally, the AID hold flag is cleared only if the AID hold flag is set.

Embodiments of the invention having being thus described, it will be apparent to one skilled in the art in view of that description that the invention may be varied in many ways. Any and all such variations are intended to be included within the scope of the invention to the extent the same falls within the scope of any of the following claims.

What is claimed is:

1. A head cleaning method for an inkjet printer, the method comprising:

detecting if a nozzle among a plurality of nozzles of an inkjet head in the inkjet printer is a defective nozzle;

determining that a first cleaning process of the inkjet head is needed when the defective nozzle is found;

detecting if the inkjet printer is in a condition corresponding to a predefined defective nozzle occurrence condition;

determining a content of the first cleaning process based on information pertaining to the predefined defective nozzle occurrence condition; and executing the first cleaning process with the determined content.

2. The head cleaning method for an inkjet printer described in claim 1, further comprising:

detecting if a nozzle of the inkjet head is a defective nozzle after the first cleaning process is executed;

determining that a second cleaning process of the inkjet head is needed when the defective nozzle is found; and executing a second cleaning process of a different content than that of the first cleaning process independently of the predefined defective nozzle occurrence condition.

3. The head cleaning method for an inkjet printer described in claim 1, wherein the defective nozzle occurrence condition includes any of shock was applied to the inkjet printer, an opening/closing member of the inkjet printer closed, the inkjet printer turned on, a predetermined time passed since the immediately preceding cleaning process or printing process was executed, and execution of the cleaning process was suspended.

4. The head cleaning method for an inkjet printer described in claim 2, wherein:

the content of the first cleaning process includes discharging or vacuuming a first amount of ink from the nozzles, and the content of the second cleaning process includes discharging or vacuuming a second amount of ink from the nozzles, the second amount of ink being different from the first amount of ink.

5. The head cleaning method for an inkjet printer described in claim 4, wherein the first amount of ink is less than the second amount of ink.

6. An inkjet printer, comprising:

a nozzle check unit that executes a first nozzle check process of detecting if a nozzle among a plurality of nozzles of an inkjet head in the inkjet printer is a defective nozzle;

a cleaning unit that cleans the inkjet head;

a cleaning process content determination unit that determines whether a first content or a second content, different from the first content, of a first cleaning process is to be performed based on a determination as to whether a predefined defective nozzle occurrence condition occurred; and a control unit that controls the cleaning unit to execute the first content of the first cleaning process when a defective nozzle is detected by the nozzle check process.

7. The inkjet printer described in claim 6, wherein:

the nozzle check unit executes a second nozzle check process of detecting if a nozzle is a defective nozzle after the first cleaning process is executed.

8. The inkjet printer described in claim 7, wherein:

the cleaning process content determination unit determines the content of a second cleaning process for recovering the defective nozzle independently of the predefined defective nozzle occurrence condition after the first cleaning process is executed, and the control unit controls the cleaning unit to execute the second cleaning process of the determined content when the defective nozzle is found by the nozzle check process after the first cleaning process is executed.

9. The inkjet printer described in claim 6, wherein the defective nozzle occurrence condition includes any of:

shock was applied to the inkjet printer, an opening/closing member of the inkjet printer closed, the inkjet printer turned on, a predetermined time passed since the immediately preceding cleaning process or printing process was executed, and execution of the cleaning process was suspended.

10. The inkjet printer described in claim 6, wherein:

the first content of the first cleaning process includes discharging or vacuuming a first amount of ink from the nozzles, and the second content of the first cleaning process includes discharging or vacuuming a second amount of ink from the nozzles, the second amount of ink being different from the first amount of ink.

11. The inkjet printer described in claim 10, wherein the first amount of ink is less than the second amount of ink.

* * * * *